US006283056B1

(12) United States Patent
Tchaikovsky

(10) Patent No.: US 6,283,056 B1
(45) Date of Patent: Sep. 4, 2001

(54) COMPONENTS OF INFLATABLE OBJECTS

(75) Inventor: Vladislav Tchaikovsky, Santa Monica, CA (US)

(73) Assignee: Sevylor U.S.A., Inc., Los Angeles, CA (US)

( * ) Notice: Subject to any disclaimer, the term of this patent is extended or adjusted under 35 U.S.C. 154(b) by 0 days.

(21) Appl. No.: 09/578,338

(22) Filed: May 25, 2000

(51) Int. Cl.[7] ..... B63B 7/00
(52) U.S. Cl. ..... 114/345
(58) Field of Search ..... 114/345, 357, 114/219; 441/40

(56) References Cited

U.S. PATENT DOCUMENTS 2,639,750 * 5/1953 Phane ..... 114/345
3,935,607 * 2/1976 Cantwell et al. ..... 114/345
4,919,067 * 4/1990 Wenstob et al. ..... 11/345
5,282,436 2/1994 Hansen .
5,732,650 * 3/1998 Peterson ..... 114/345
5,878,685 3/1999 Hemphill et al. .
5,943,978 8/1999 Garnier .

* cited by examiner

*Primary Examiner*—Stephen Avila
(74) *Attorney, Agent, or Firm*—Dean W. Russell; Kilpatrick Stockton LLP

(57) ABSTRACT

Boats having one or more inflatable inner members or tubes incorporated into their fenders are described herein. Also described are valve assemblies for use with such inner tubes, the assemblies permitting relatively easy removal of the inner tubes when necessary as well as inflation and deflation thereof.

10 Claims, 7 Drawing Sheets

COMPONENTS OF INFLATABLE OBJECTS

FIELD OF THE INVENTION

This invention relates to fixtures for use in connection with inflatable objects and more particularly for valves or other components connected to inner tubes of inflatable boats.

BACKGROUND OF THE INVENTION

U.S. Pat. No. 5,943,978 to Garnier, incorporated herein in its entirety by this reference, illustrates an exemplary boat having inflatable tubes as fenders and, among other components, a transom. The tubes of the boat are designed to be inflated with air to make the boat buoyant in water. The transom, to which an outboard motor may be fitted, typically is formed of wood or another sturdy material such as (but not limited to) metal.

Because in use the exteriors of the tubes contact multiple objects, their puncture and wear characteristics may be significant. To reduce the likelihood of premature puncture or wear of many tubes, manufacturers coat or cover them with puncture-inhibiting chemicals or fabrics. Alternatively or additionally, manufacturers may fill the tubes with foam (rather than air) to minimize their buoyancy loss should the tubes be punctured or torn. U.S. Pat. No. 5,282,436 to Hansen describes certain variations of such foam-filled tubes, calling them "stabilizing members." Notwithstanding inclusion of buoyant foam in the members, the boats of the Hansen patent may nevertheless need the exteriors of the stabilizing members to be coated or covered "with a protective material, such as a rubber, liquid vinyl or some other plastic material" to "increase damage tolerance." See Hansen, col. 6, 11. 21–25.

U.S. Pat. No. 5,878,685 to Hemphill, et al., also incorporated herein in its entirety by this reference, describes additional foam-collared boats. Disclosed in the Hemphill patent are two coatings for the collars, preferably a urethane elastomer for use as one coating and two-component polyurethane system for the other. Both coatings are detailed as being capable of providing at least some abrasion-resistance, with the first above-described coating also designed to supply "strength" and "elongation." See Hemphill, col. 4, 11. 28–64.

SUMMARY OF THE INVENTION

The present invention provides alternative methods of enhancing the damage resistance of objects such as boats, particularly those having inflatable tubes or "fenders." Rather than filling foam into the fenders, the present invention incorporates one or more inflatable inner members or tubes into the fenders Additionally included as part of the invention is an innovative valve assembly, which facilitates inflation and deflation of the inner tubes.

Thus, rather than requiring the tubular fenders to be coated or covered with further protective material, the present invention permits the fenders themselves to function as protective material for the inflatable inner tubes. The fenders may, of course, be coated or covered for additional protection. Nevertheless, such coating or covering is not absolutely necessary for satisfactory damage resistance.

Inner tubes of the invention typically are inserted within the fenders and inflated so that the fenders fit snugly about them. However, because the fenders themselves are usually sealed (or nearly so) from the ambient environment, removal of the inner tubes from the fenders for repair, replacement, addition of air, or otherwise may be difficult. The invention therefore includes a valve assembly adapted for connection to both the inner tubes and fenders and which facilitates removal of the inner tubes when necessary.

In use, a valve assembly is attached to its associated inner tube, preferably (although not necessarily) near an end thereof. As attached, the valve assembly and inner tube combination presents a combined object capable of being sealed and thereby isolated from its ambient external environment. By opening a valve formed as part of the assembly, air (or other fluid) may be caused to flow into or out of the inner tube, hence inflating or deflating it.

Unlike existing devices, the valve assembly of the present invention also may be connected to the outer fenders and have portions detached therefrom without opening the valve. Stated differently, even after an inner tube is inserted into a fender and inflated, it may easily be deflated and removed from the fender merely by grasping part of the assembly and pulling to withdraw it from the corresponding fender. The present invention thus permits both facile removal of the inner tubes from a boat or other object and inflation and deflation thereof.

After removal of the detachable portion of the assembly and the inner tube connected thereto, the associated fender will have an opening large enough to reinsert an (uninflated) inner tube—either the same inner tube or, if the original inner tube is to be replaced, a new one. Because the inner tubes typically are elongated, the end of each inner tube opposite the assembly advantageously may have an end of a cord connected to it, with the other end of the cord capable of being pulled to draw the inner tube the length of the interior of the fender. This permits the shape of the inserted inner tube to match more closely that of the associated fender so as to facilitate inflating the inner tube therein.

It thus is an object of the present invention to provide inflatable inner tubes and associated valve assemblies for objects including boats.

It is also an object of the present invention to provide inflatable boats having enhanced damage-resistance without resort to use of foam or protective coatings or coverings for the fenders.

It is an additional object of the present invention to provide alternate valve assemblies for inflatable objects, the assemblies facilitating inflation and deflation of the inner tubes.

It is a further object of the present invention to provide valve assemblies adapted for connection jointly to both an inner tube and a corresponding fender and having a portion detachable from at least the fender to allow withdrawal of the inner tube from within the fender.

Other objects, features, and advantages of the present invention will be apparent to those skilled in the relevant art with reference to the remaining text and the drawings of this application.

DETAILED DESCRIPTION

Figure 1:
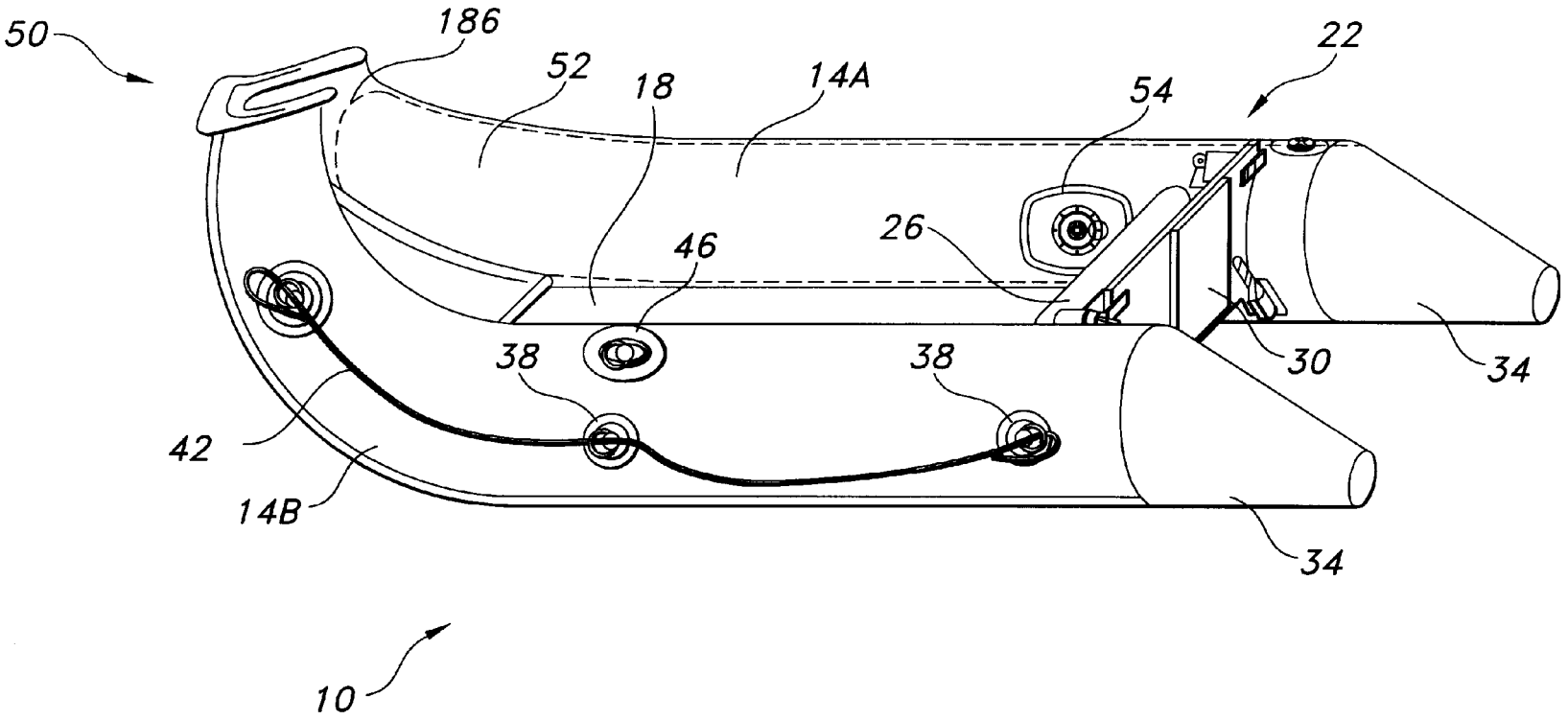
FIG. 1 is a perspective view of an exemplary boat of the present invention.
Figure 2A:
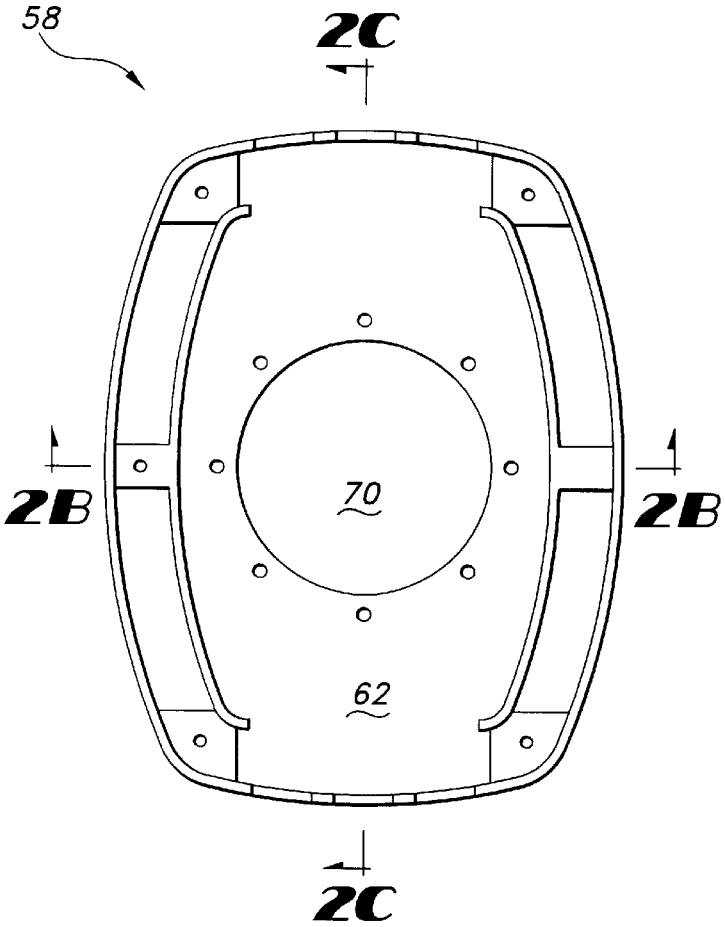
FIG. 2A is a plan view of the outer base of a valve assembly of the present invention for use as part of the boat of FIG. 1.
Figure 2C:
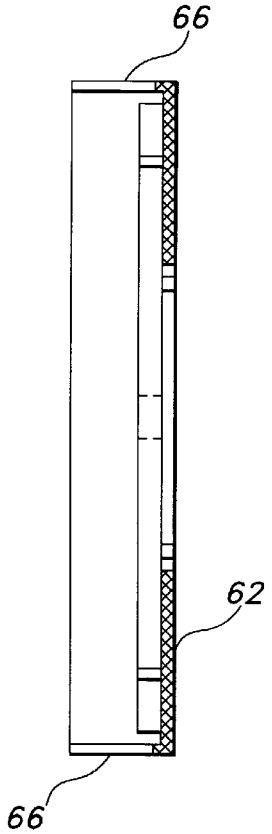
FIG. 2C is a cross-sectional view of the outer base of FIG. 2A taken along lines C—C of that figure.
Figure 2B:
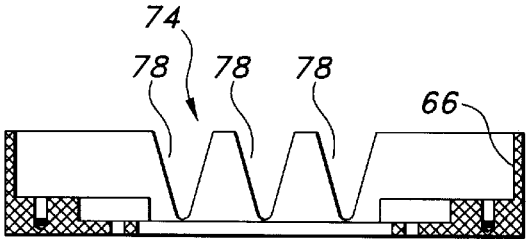
FIG. 2B is a cross-sectional view of the outer base of FIG. 2A taken a along lines B—B of that figure.

Illustrated in FIG. 1 is an exemplary boat 10 of the present invention. Boat 10 of FIG. 1 includes two fenders 14 (denoted 14A and 14B), one forming each of the port and starboard sides thereof, and floor 18. Optionally additionally included as part of boat 10 may be transom 22, which if desired may comprise inflatable portion 26 and non-inflatable portion 30, and generally frusto-conically-shaped segments 34 typically (but not necessarily) integrally formed with fenders 14A and 14B. Yet other options for boat 10 shown in FIG. 1 include D-ring assemblies 38, through which cord 42 may be strung to facilitate handling of boat 10, and oar locks 46. Assemblies 38 and locks 46 typically are attached to each of fenders 14A and 14B, although FIG. 1 affirmatively illustrates such items connected only to fender 14B.

In preferred embodiments of boat 10, fenders 14A and 14B do not permit fluid communication therebetween, rather being sealed from each other in the area near bow 50. Such isolation is not a requirement of the invention, however, so fenders 14A and 14B indeed may communicate if necessary or desired. Likewise, having exactly two fenders 14A and 14B as part of boat 10 is not mandated by the present invention, and fewer or greater numbers of fenders may be utilized instead.

Within each of fenders 14A and 14B may be an inflatable inner tube 52 shown in phantom lines in FIG. 1. Inner tube 52 is formed of a material, such as (but not limited to) polyvinyl chloride, capable of retaining air for an extended period. Inner tube 52 also may (but need not necessarily) be generally cylindrically shaped and, when inflated, abut much of the interior surface of its associated fender 14, thus causing the fender 14 to be shaped similarly. Each of fenders 14A and 14B may thus form a protective cover for its associated inner tube 52, avoiding any requirement that the fenders 14 also be covered or coated for protection. As noted earlier, however, fenders 14 can be so coated or covered if desired.

Valve assembly 54 additionally appears in FIG. 1. Typically, each inner tube 52 of boat 10 will have connected thereto a valve assembly 54, which permits not only inflation and deflation of the inner tube 52, but also facilitates removing the inner tube 52 from the corresponding fender 14. Valve assembly 54 additionally may be attached to a fender 14 (see. e.g., fender 14A in FIG. 1), although detachably so in order to remove inner tube 52 from within. Preferred embodiments of boat 10 include one or more valve assemblies 54, each having portions detachably connected to fender 14 and permanently connected to an inner tube 52.

FIGS. 2A–5C detail components of a sample valve assembly 54 of the present invention. Illustrated in FIGS. 2A–C, for example, are various views of outer base 58 of assembly 54. Outer base 58 may comprise bottom 62 and side walls 66 integrally formed therewith, with bottom 62 defining central opening 70 therein. Walls 66, moreover, may include serrations 74, with one more recessed areas 78 being adapted to receive complimentary trusions 80 of inner base 82.

Figure 3A:
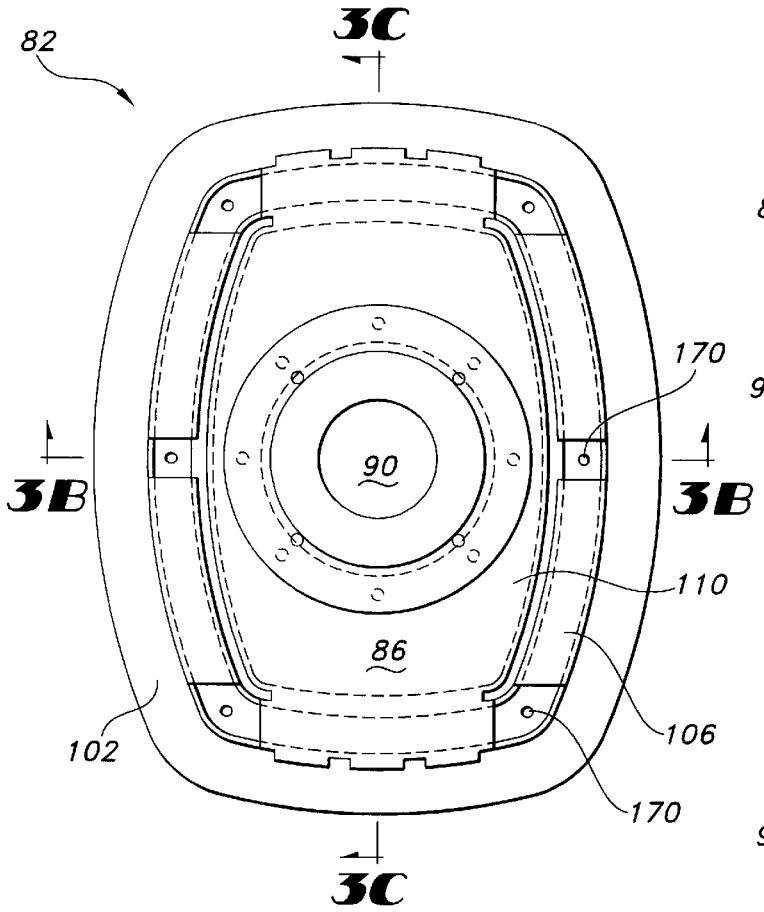
FIG. 3A is a plan view of the inner base of the valve assembly of present invention for use as part of the boat of FIG. 1.
Figure 3C:
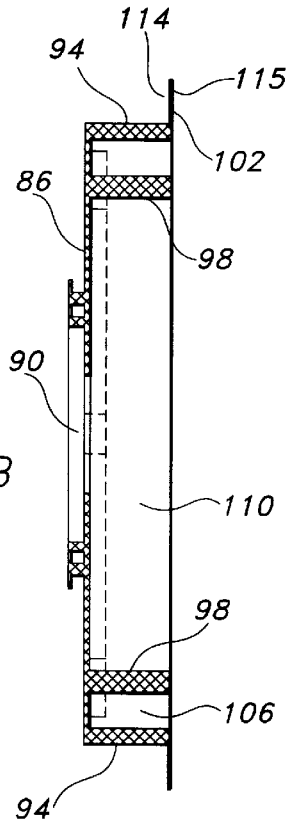
FIG. 3C is a cross-sectional view of the inner base of FIG. 3A taken along lines C—C of that figure.
Figure 3B:
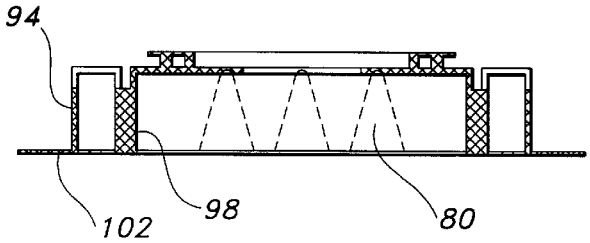
FIG. 3B is a cross-sectional view of the inner base of FIG. 3A taken along lines B—B of that figure.

Indeed, shown in FIGS. 3A–C is inner base 82. Like outer base 58, inner base 82 includes bottom 86 with a central opening 90 therein as well as side walls 94. In use, inner base 82 is inserted into outer base 58 so that bottom 86 abuts bottom 68 and side walls 94 abut side walls 66, with protrusions 80 received by recesses 78. As so inserted, furthermore, inner base 82 has its central opening 90 aligned with central opening 70 of outer base 58. If desired, inner base 82 may be permanently attached to outer base 58 once inserted therein.

Additionally included in many embodiments of inner base 82 are interior walls 98 and flange 102, the latter protruding outward from side walls 94. Inner base 82 thus creates two distinct recesses 106 and 110, with recess 106 being formed between side walls 94 and interior walls 98. Recess 110, by contrast, is the area bounded by interior walls 98.

Figure 4A:
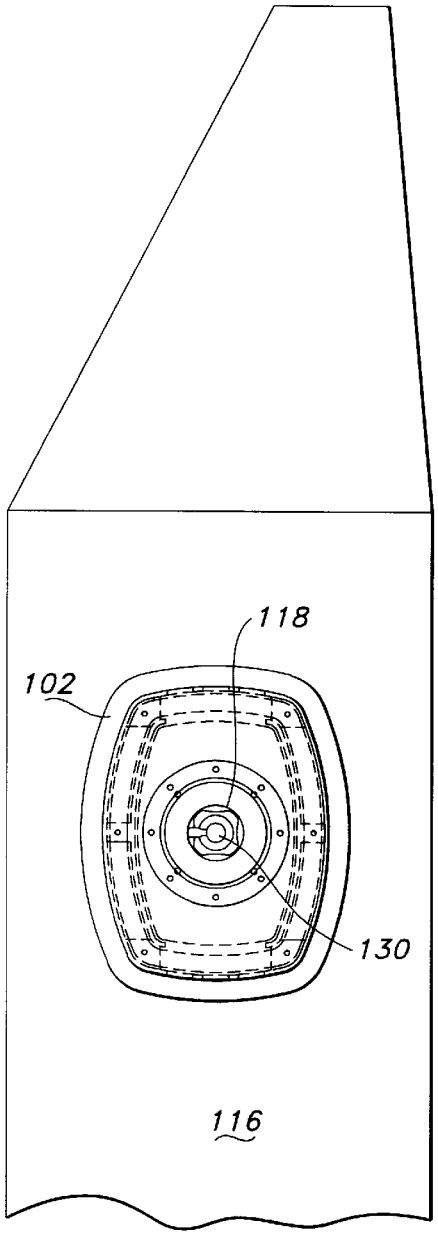
FIG. 4A is a side view of an inflatable inner tube of the present invention.
Figure 4B:
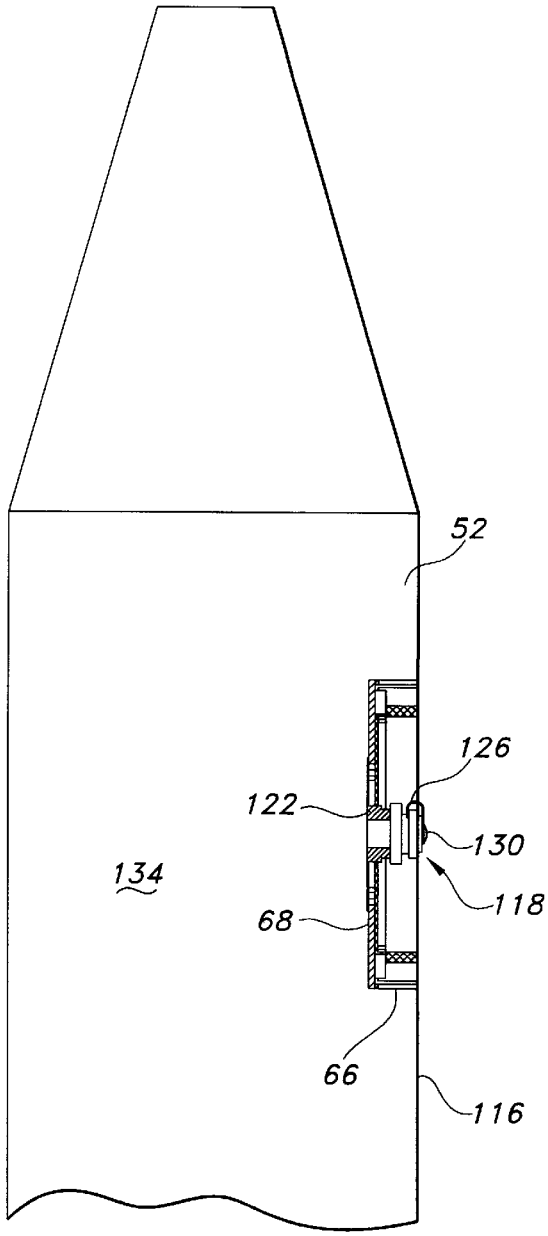
FIG. 4B is a cross-sectional view of the inner tube of FIG. 4A.

As fitted together, inner base 82 and outer base 58 form a structure adapted to be connected to inflatable inner tube 52 of boat 10, as detailed in FIGS. 4A–B. Underside 114 or, preferably, upper side 115 of flange 102 may be welded (using RF energy or otherwise) or attached, bonded, or connected in any suitable manner to (typically) exterior surface 116 of inner tube 52, with side walls 66 and bottom 68 extending into the interior volume of tube 52 through an opening created therein. Because of the tight (friction) fit or other attachment between inner base 82 and outer base 58, after the structure is connected to inner tube 52, tube 52 remains sealed from the ambient environment except at aligned openings 70 and 90, through which fluid may enter and exit the interior volume of tube 52.

FIG. 4-B also illustrate valve 118 useful as part of the present invention. In some embodiments of boat 10, valve 118 is a valve commonly known as a "Boston" valve and is fitted into openings 70 and 90. Those skilled in the art will, of course, recognize that other appropriate valving mechanisms may be substituted for the Boston-style valve shown in FIG. 4-B.

Nevertheless, if a Boston valve, valve 118 may include flanged retainer 122, which may be fitted into openings 70 and 90 with its flanges retaining it in position. Retainer 122 need not be flanged, however, and instead may be welded or otherwise formed or fitted in place in any manner suitable for the plastics materials of which valve assembly 54 preferably (although not necessarily) is made. Retainer 122 additionally may have a threaded interior bore into which valving member 126 may be inserted, and member 126 may include cap 130 which, when removed, provides access to a chamber within member 126 to which a pump or other source of pressurized fluid may be connected. To inflate tube 52 with air, therefore, one need merely remove cap 130, attach an air source to member 126, and allow the air to flow through member 126 and retainer 122 of valve 118 into the interior 134 of tube 52.

Figure 5A:
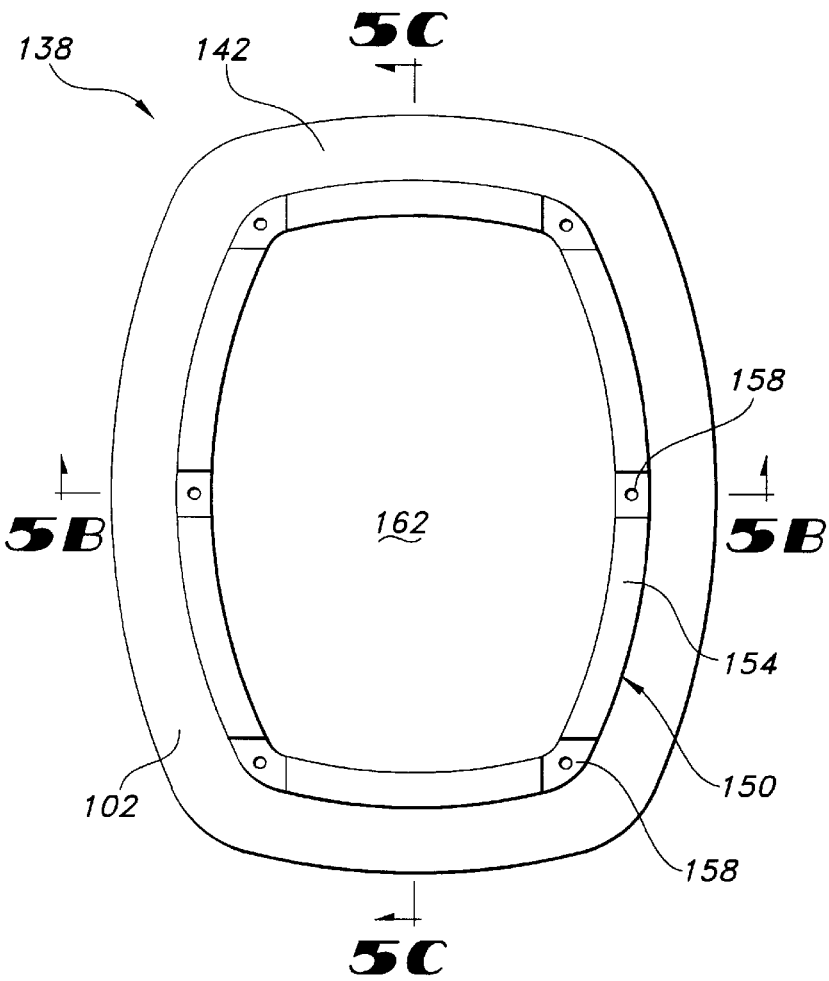
FIG. 5A is a plan view of an external fitting of the valve assembly of the present invention for use as part of the boat of FIG. 1.
Figure 5C:
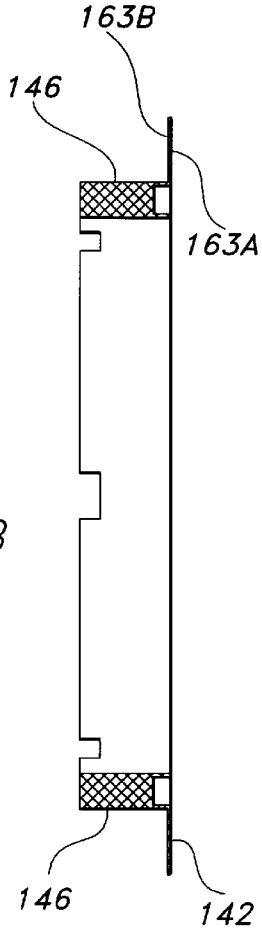
FIG. 5C is a cross-sectional view of the external fitting of FIG. 5A taken along lines C—C of that figure.
Figure 5B:
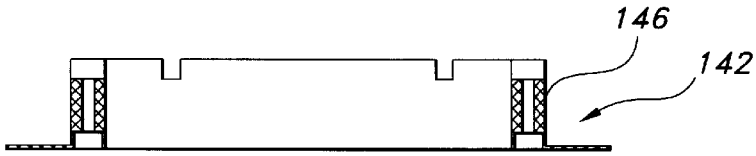
FIG. 5B is a cross-sectional view of the external fitting of FIG. 5A taken along lines B—B of that figure.
Figure 6A:
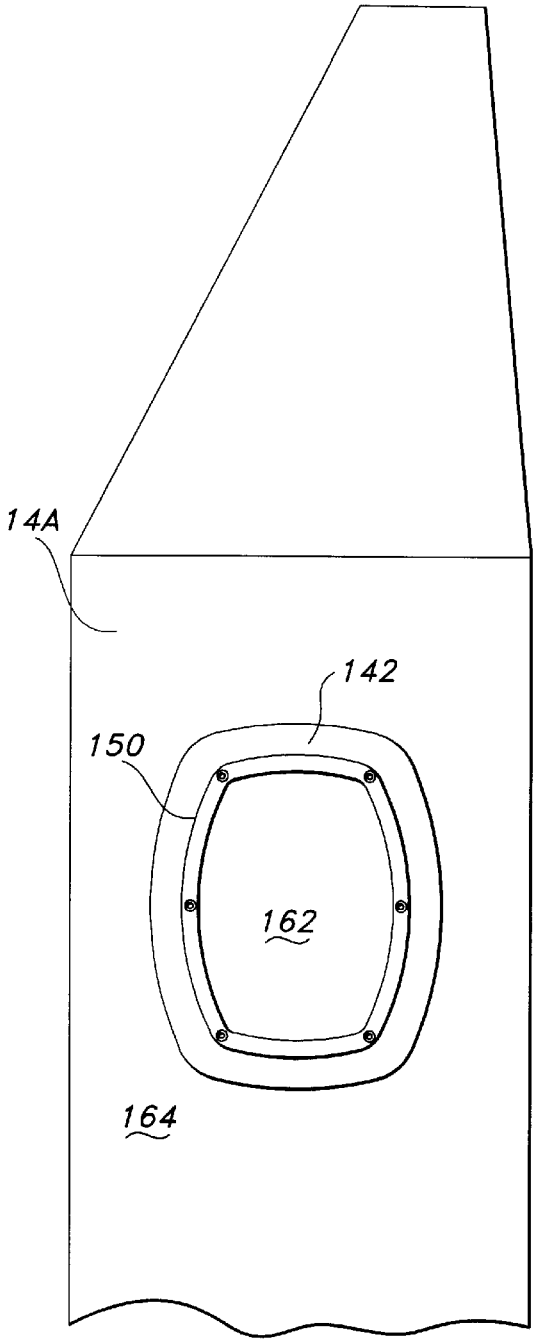
FIG. 6A is a side view of a fender of the boat of the present invention.
Figure 6B:
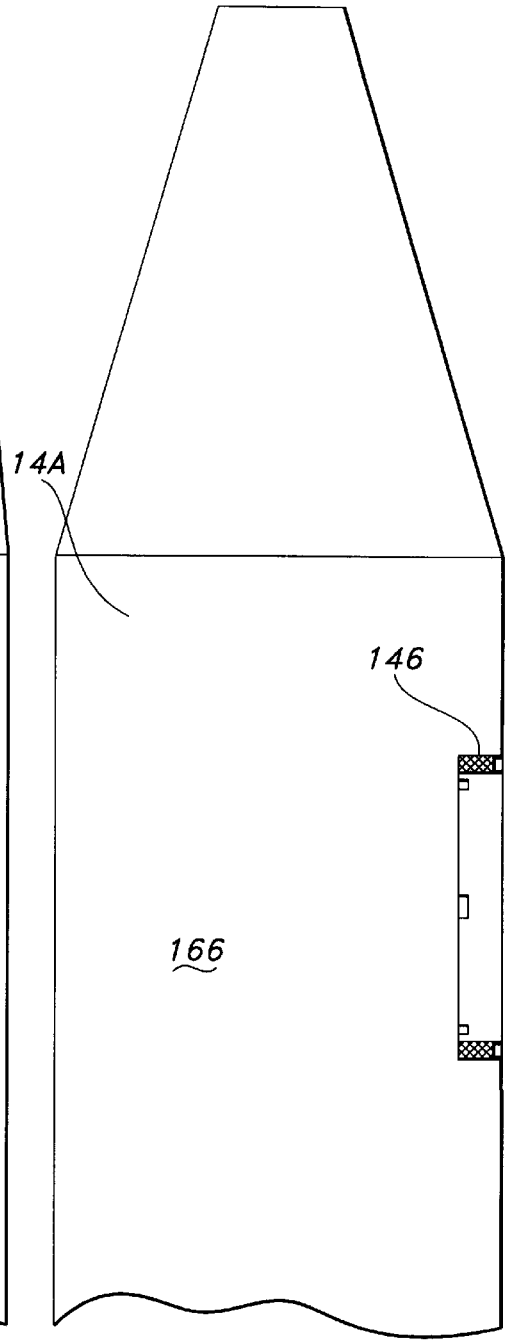
FIG. 6B is a cross-sectional view of the fender of FIG. 6A.

Detailed in FIGS. 5A–C is external fitting 138. Fitting 138 may include flange 142 and side walls 146 extending downward therefrom. Formed intermediate flange 142 and walls 146 may be recess 150, the base 154 of which includes one or more openings 158. Side walls 146, further, bound an opening 162. In use, upper side 163A or underside 163B of flange 142 may be welded or otherwise attached to the exterior 164 of fender 14A or 14B (see FIGS. 6A–B), with side walls 146 intending into interior 166 of the fender 14 through an opening therein. When inner tube 52 likewise is positioned within interior 166, side walls 146 are adapted to fit into and be received by recess 106 of inner base 82. Further, as so fitted, openings 158 are aligned with corresponding openings 170 of inner base 82, with the openings 158 and 170 receiving screws or other fasteners to fasten fitting 138 and inner base 82 together.

Figure 7A:
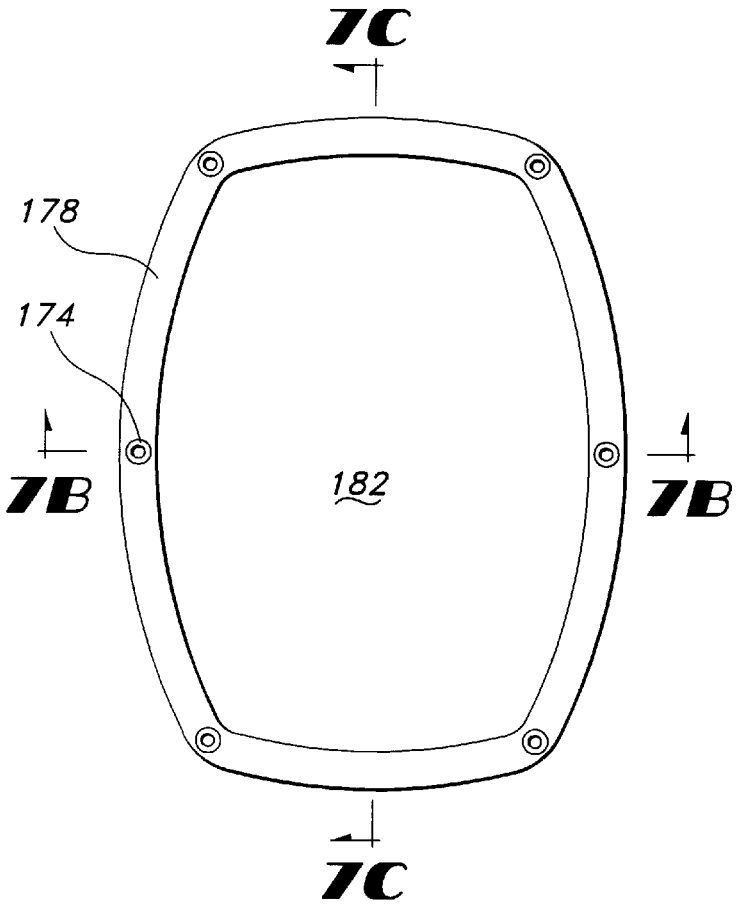
FIG. 7A is a plan view of a ring of the valve assembly of the present invention for use as part of the boat of FIG. 1.
Figure 7C:
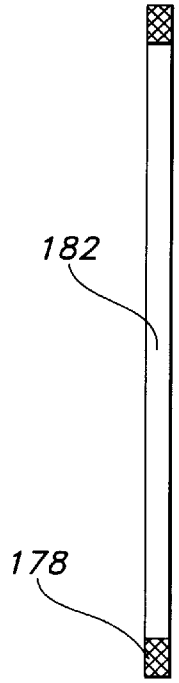
FIG. 7C is a cross-sectional view of the ring of FIG. 7A taken along lines C—C of that figure.
Figure 7B:
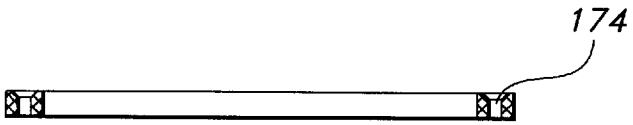
FIG. 7B is a cross-sectional view of the ring of FIG. 7A taken along lines B—B of that figure.

Such screws or fasteners additionally may penetrate openings 174 of ring 178 (FIGS. 7A–C) and the fabric or other material from which fenders 14 is formed. In use, ring 178 fits into recess 150 and, like fitting 138, bounds an opening 182. Aligned openings 182 and 162 thus provide access to the interior 166 of fender 14A or 14B after flange 142 is connected to exterior 164.

To position an inner tube 52 within interior 166, the tube 52 (in an uninflated or partially-inflated state) may be fed, or "stuffed," through aligned openings 182 and 162. Because inner base 82 and outer base 58 (if present) are attached to inner tube 52, they too must be inserted through aligned openings 182 and 162 (usually simply by turning or twisting them sideways) so that they are within interior 166. After inner base 82 and outer base 58 have been positioned within interior 166 of a fender 14, the fasteners may be inserted through openings 174, 170, and 158 to fasten the respective components of valve assembly 54 together.

Thereafter, inner tube 52 may be fully inflated from outside fender 14 through valve 118, and as tube 52 expands with inflation fluid, fender 14 will conform its shape to that of tube 52 (analogous to the fender serving as a cover for a balloon). Similarly, if inner tube 52 needs additional air pressure at some later time for enhanced buoyancy, such air can be provided merely by opening valve 118 and connecting it to a source of pressurized air (and hence without needing first to deflate inner tube 52 and remove it from within fender 14). Although careful application of inflation fluid may minimize the possibility of inner tube 52 kinking or otherwise not engaging in uniform expansion when being filled, an elongated section of cord may also be tied to end 186 of tube 52 and protrude through an (unshown) opening of fender 14 near bow 50, so that someone can pull the cord so as to preposition tube 52 within the length of fender 14 before commencing inflation. If indeed such cord is used, it should be long enough to extend within fender 14 approximately the entire distance between the bow and aligned openings 162 and 182, so that neither end of the cord is lost within interior 166 when inner tube 52 is removed.

In some circumstances inner tube 52 indeed may need to be removed from fender 14, as for repair, examination, or replacement, for example. Merely by removing the fasteners, inner base 82 and outer base 58 can be disconnected from fitting 138 and ring 178 and then (typically turned sideways and) pulled through aligned openings 162 and 182. Because inner base 82 and outer base 58 are connected to inner tube 52, it too is pulled through aligned openings 162 and 182 to outside fender 14.

The foregoing is provided for purposes of illustrating, explaining, and describing embodiments of the present invention. Further modifications and adaptations to these embodiments will be apparent to those skilled in the art and may be made without departing from the scope or spirit of the invention. As (non-limiting) examples of such modifications, outer base 58 may be omitted in some embodiments, while in others it may comprise a simple sleeve or cover having a cross-section generally similar to that shown in FIG. 2C. In such embodiments, the sleeve or cover may be welded or otherwise attached to inner base 82. Additionally, having recesses 78 and protrusions 80 is not a requirement of the invention, and such recesses 78 and protrusions 80 may be omitted if appropriate or desired.

What is claimed is:

1. An inflatable boat comprising:

a. a fender having an exterior surface;

b. an inflatable inner tube positioned at least partially within the fender; and c. a valve assembly connected to the inner tube and fender and adapted to permit inflation thereof while the inner tube is positioned within the fender, the valve assembly comprising:

i. a base attached to the inner tube; and ii. a fitting attached to both the exterior surface of the fender and the base.

2. A boat according to claim 1 further comprising a transom and in which the valve assembly is connected to the fender in a portion forward of the transom.

3. A boat according to claim 1 in which the base comprises a flange attached to the inner tube.

4. A boat according to claim 3 in which the fitting is attached to the base using at least one removable fastener.

5. A boat according to claim 4 in which the base defines an opening and the valve assembly is inserted into the opening so as to be connected to the inner tube.

6. A boat according to claim 5 further comprising:

a. a second fender;

b. a second inflatable inner tube positioned within the second fender; and c. a second valve assembly connected to the second inflatable inner tube.

7. A boat according to claim 2 in which the transom has an inflatable portion.

8. An inflatable boat comprising:

a. a fender having an exterior surface and defining an interior space;

b. an inflatable inner member positioned at least partially within the interior space; and c. a valve assembly connected to both the inflatable inner member and the fender and comprising a valve accessible from outside the exterior surface of the fender, the valve assembly comprising:

i. a component permanently connected to the inflatable inner member; and ii. a component connected to but detachable from both the inflatable inner member and the exterior surface of the fender.

9. A boat according to claim 8 further comprising a transom having an inflatable portion.

10. An inflatable boat comprising:

a. a fender;

b. an inflatable inner tube defining an interior volume and positionable at least partially within the fender; and c. a valve assembly connected in use to the inner tube and fender and adapted to permit inflation thereof while the inner tube is positioned within the fender, the valve assembly comprising:

i. a base attached to the inner tube so as to extend at least partially into the interior volume, the base having a first opening and a second opening;

ii. a valve fitted into the first opening;

iii. an external fitting attached to the fender and having a third opening alignable in use with the second opening; and iv. means, insertable through the aligned second and third openings, for fastening together the base and external fitting.

* * * * *